US009843123B1

(12) United States Patent
Klein et al.

(10) Patent No.: US 9,843,123 B1
(45) Date of Patent: Dec. 12, 2017

(54) ELECTRICAL CONNECTOR WITH TERMINAL POSITION ASSURANCE CLIP

(71) Applicant: TYCO ELECTRONICS CORPORATION, Berwyn, PA (US)

(72) Inventors: David Allen Klein, Kernersville, NC (US); David Charles Strausser, Winston Salem, NC (US); Kevin John Peterson, Kernersville, NC (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/244,580

(22) Filed: Aug. 23, 2016

(51) Int. Cl.
*H01R 13/436* (2006.01)
*H01R 13/428* (2006.01)

(52) U.S. Cl.
CPC ..... *H01R 13/436* (2013.01); *H01R 13/428* (2013.01)

(58) Field of Classification Search
CPC ..... H01R 13/4365; H01R 13/4223; H01R 13/4361; H01R 13/4364
USPC ..... 439/752, 595
See application file for complete search history.

(56) References Cited

U.S. PATENT DOCUMENTS 4,944,688 A * 7/1990 Lundergan ..... H01R 13/5221 439/275
5,252,088 A * 10/1993 Morello ..... H01R 4/185 439/271
6,083,057 A * 7/2000 Annecke ..... H01R 13/4362 439/752
6,764,334 B2 * 7/2004 Tsuji ..... H01R 13/4223 439/595
7,476,133 B2 * 1/2009 Tanaka ..... H01R 13/4364 439/752
8,408,950 B2 * 4/2013 Jeon ..... H01R 13/4365 439/595
8,708,739 B2 * 4/2014 Takeda ..... H01R 13/4223 439/595
2002/0076992 A1 * 6/2002 Kurimoto ..... H01R 13/4362 439/752
2002/0076995 A1 * 6/2002 Kurimoto ..... H01R 13/4362 439/752
2003/0054690 A1 * 3/2003 Fukatsu ..... H01R 43/16 439/595

(Continued)

OTHER PUBLICATIONS

TE Connectivity Automotive; AMPSEAL 16 Connector System; Section Catalog 1654281-2; Revised Apr. 2010; Main Catalog 1654400-1; Chapter 30; Issued Apr. 2010; 32 pages.

*Primary Examiner* — Gary Paumen

(57) ABSTRACT

An electrical connector includes a housing that defines a cavity at a mating end. A terminal retention (TR) block is mounted to the housing within the cavity. The TR block defines multiple channels configured to receive contacts therein. The channels include deflectable retention latches configured to engage the contacts to retain the contacts in the channels. A terminal position assurance (TPA) clip is mounted to a distal end of the TR block within the cavity of the housing. The TPA clip is configured to block deflection of the retention latches to lock the contacts in the channels. The TPA clip has slots that align with the channels of the TR block and receive distal tips of the contacts therethrough. The slots have tapered lead-ins configured to guide the distal tips of the contacts from the channels into the slots.

20 Claims, 5 Drawing Sheets

(56) References Cited

U.S. PATENT DOCUMENTS

| | | | | |
|---|---|---|---|---|
| 2010/0041280 | A1* | 2/2010 | Morello | H01R 13/422<br>439/752 |
| 2010/0105254 | A1* | 4/2010 | Park | H01R 13/40<br>439/752 |

* cited by examiner

ELECTRICAL CONNECTOR WITH TERMINAL POSITION ASSURANCE CLIP

BACKGROUND OF THE INVENTION

The subject matter herein relates generally to electrical connectors that have terminal position assurance clips.

Some electrical connectors include conductive contacts, such as pin contacts, that are retained in the connectors using retention features, such as latches. To prevent unintended movement of the retention features which may allow the contacts to be pulled or pushed out of the connectors, some electrical connectors include terminal position assurance (TPA) devices. The TPA devices are configured to block movement of the retention features that would allow the retention features to disengage the contacts. Some TPA devices are inserted over distal ends of the contacts and have narrow openings through which the contacts extend. The contacts are guided through the narrow openings by guidance features, such as ramps, bumps, and guide posts, in the TPA device and/or in a contact retention portion of the connector.

There is a current trend of increasing signal density in connectors by increasing the amount of contacts per a given area of the connector. To increase the signal density, many connectors employ smaller contacts and reduce the size of the components of the connectors in proportion to the contacts. Thus, to decrease the size of the electrical connectors that have TPA device described above, the retention features and the guidance features that retain and guide the contacts, respectively, are scaled down. Many of the retention and guidance features are relatively complex to design tooling for and to manufacture already, and minimizing the size of these features adds to the complexity as well as causes additional issues. For example, at least some of the retention features and guidance features may be molded using metal molds. Decreasing the size of the features requires finer metal walls of the molds that define the features. In order to meet the size requirements, some of the metal walls may be so fine that the walls are prone to bending or breaking when the mold is injected with hot filler material, which ruins or at least damages the resulting product. In another example, it is recognized that the retention features and the guidance features must have some resiliency in order to absorb impact forces from the contacts, such as when the contacts are being loaded into the connector or when the contacts are being pushed or pulled by a mating connector. By decreasing the size of the connectors to increase signal density, the retention features and the guidance features may be reduced to a size such that the features lack the required strength to retain and/or guide the contacts. For example, if the guide posts are small and thin enough, the guide posts may bend upon impact from a contact and not provide the desired guidance for the contact. Thus, by reducing the size of the electrical connectors, known retention and guidance features, such as ramps, bumps, and guide posts, may become exceedingly difficult, complex, and/or expensive to produce and may also fail to provide the desired levels of retention and guidance for the contacts.

A need remains for an electrical connector having a TPA device that simplifies the retention and guidance features in order to provide for reliable retention and guidance in smaller-sized, higher signal density connectors.

BRIEF DESCRIPTION OF THE INVENTION

In one embodiment, an electrical connector is provided that includes a housing, a terminal retention (TR) block, and a terminal position assurance (TPA) clip. The housing has a mating end and a terminating end. The housing defines a cavity open at the mating end. The TR block is mounted to the housing within the cavity. The TR block defines multiple channels configured to receive contacts therein. The channels extend between a proximal end and a distal end of the TR block. The channels include deflectable retention latches configured to engage the contacts to retain the contacts in the channels. The TPA clip is mounted to the distal end of the TR block within the cavity of the housing. The TPA clip is configured to block deflection of the retention latches to lock the contacts in the channels. The TPA clip has slots that align with the channels of the TR block and receive distal tips of the contacts therethrough. The slots have tapered lead-ins configured to guide the distal tips of the contacts from the channels into the slots.

In another embodiment, an electrical connector is provided that includes a housing, a terminal retention (TR) block, multiple contacts, and a terminal position assurance (TPA) clip. The housing has a mating end and a terminating end. The housing defines a cavity open at the mating end. The TR block is mounted to the housing within the cavity. The TR block defines multiple channels extending between a proximal end and a distal end of the TR block. The channels each include a deflectable retention latch therein. The contacts are disposed within corresponding channels of the TR block. Each contact engages and is retained in the respective channel by a corresponding one of the retention latches. The TPA clip is mounted to the distal end of the TR block within the cavity of the housing. The TPA clip is configured to block deflection of the retention latches to lock the contacts in the channels. The TPA clip has slots that align with the channels of the TR block and receive distal tips of the contacts therethrough. The slots have tapered lead-ins configured to guide the distal tips of the contacts from the channels into narrow portions of the slots. The tapered lead-ins are conical and provide 360 degree guidance for the distal tips into the narrow portions of the slots.

DETAILED DESCRIPTION OF THE INVENTION

Figure 1:
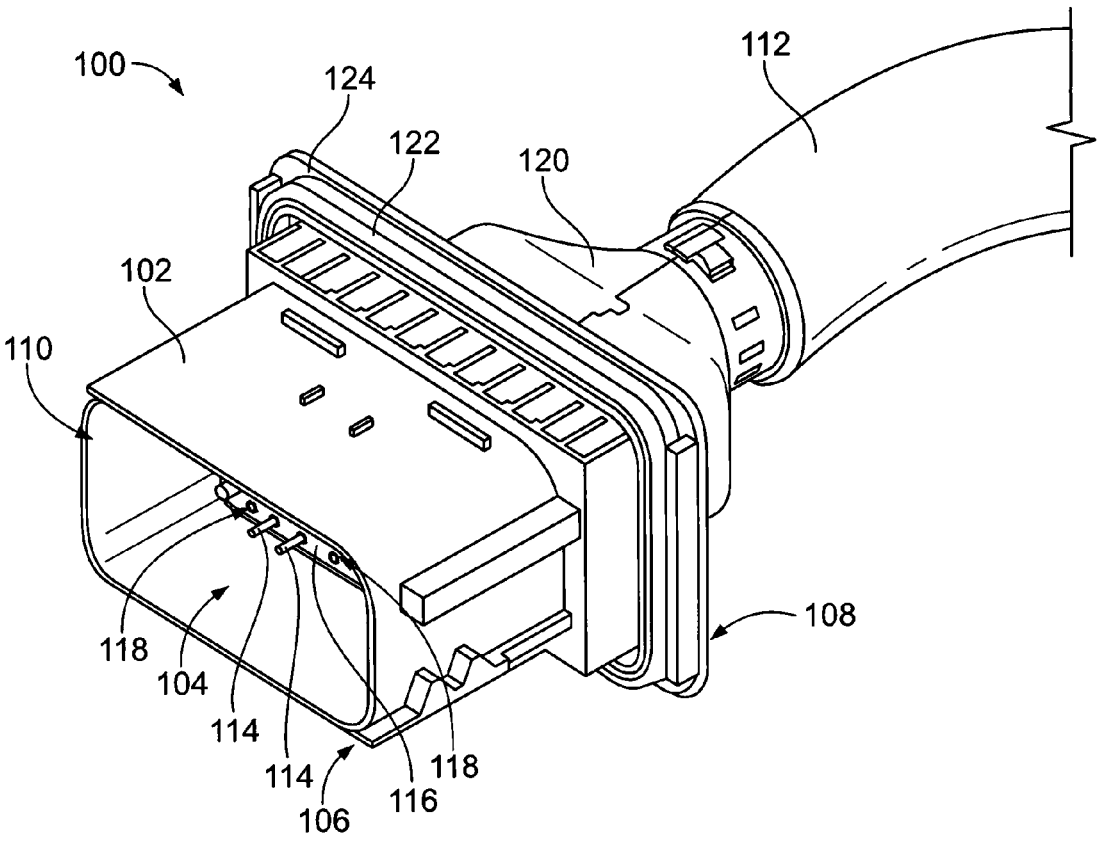
FIG. 1 is a perspective view of an electrical connector in accordance with an embodiment.

FIG. 1 is a perspective view of an electrical connector 100 in accordance with an embodiment. The electrical connector 100 includes a housing 102 that defines a cavity 104. The housing 102 has a mating end 106 and a terminating end 108. The mating end 106 includes an opening 110 to the cavity 104. The mating end 106 is configured to interface with a mating connector (not shown) to mate with the mating connector and provide a signal path between the connector 100 and the mating connector. The mating connector may be a bulkhead connector. In the illustrated embodiment, a cable 112 extends from the terminating end 108 of the housing 102. The cable 112 includes one or more conductive wires. The connector 100 may be configured to be mounted directly to a device, such as a transmission or an engine of a vehicle. In alternative embodiments, instead of terminating to a cable, the electrical connector 100 may be mounted directly to a printed circuit board. For example, the connector 100 may be a right angle connector such that a plane of the mating end 106 is perpendicular to a top surface of a printed circuit board to which the connector is mounted or may be a vertical connector such that the plane of the mating end 106 is parallel to the top surface of the circuit board.

Within the cavity 104, the electrical connector 100 includes multiple contacts 114. The contacts 114 are shown as pin contacts. The pin contacts 114 are configured to be received in corresponding openings of socket contacts of the mating connector. The contacts 114 are not limited to being pin contacts. For example, the contacts 114 may be socket contacts configured to receive pins of a mating connector. The contacts 114 may be deflectable beam-style contacts in another embodiment. The contacts 114 may be configured to convey electrical and/or optical signals. The contacts 114 may be referred to as terminals. The electrical connector 100 further includes a terminal position assurance (TPA) clip 116 within the cavity 104. The TPA clip 116 includes multiple slots 118. The contacts 114 extend through the slots 118 and beyond the TPA clip 116 into the cavity 104. As described below, the TPA clip 116 is configured to provide a secondary retention mechanism that locks the contacts 114 in a fixed position relative to the housing 102.

Optionally, the electrical connector 100 further includes a cable cover 120. The cable cover 120 surrounds and protects the interface between the cable 112 and the housing 102. For example, the cable cover 120 may provide strain relief and may block contaminants (for example, liquid, dirt, dust, sand, etc.) from entering the cable 112 and/or the housing 102 at the interface therebetween. Optionally, the electrical connector 100 includes a compressive seal 122. The compressive seal 122 extends around a perimeter of the housing 102 proximate to the terminating end 108. The compressive seal 122 is positioned against a flange 124 of the housing 102. The compressive seal 122 engages the mating bulkhead connector when mated to the electrical connector 100. The compressive seal 122 at least partially compresses and seals the interface between the mating bulkhead connector and the connector 100, preventing the passage of contaminants therethrough. In another embodiment, the compressive seal 122 or another seal may be configured to seal to a panel of a device, such as the cover of a transmission, in order to prevent contaminants from passing through the interface between the panel and the connector 100. Thus, the electrical connector 100 may include one or more sealing and strain relief components. The electrical connector 100 may be used in relatively harsh environments for signal communication, such as with commercial vehicles for example, where the connector 100 is exposed to vibration and various contaminants.

Figure 2:
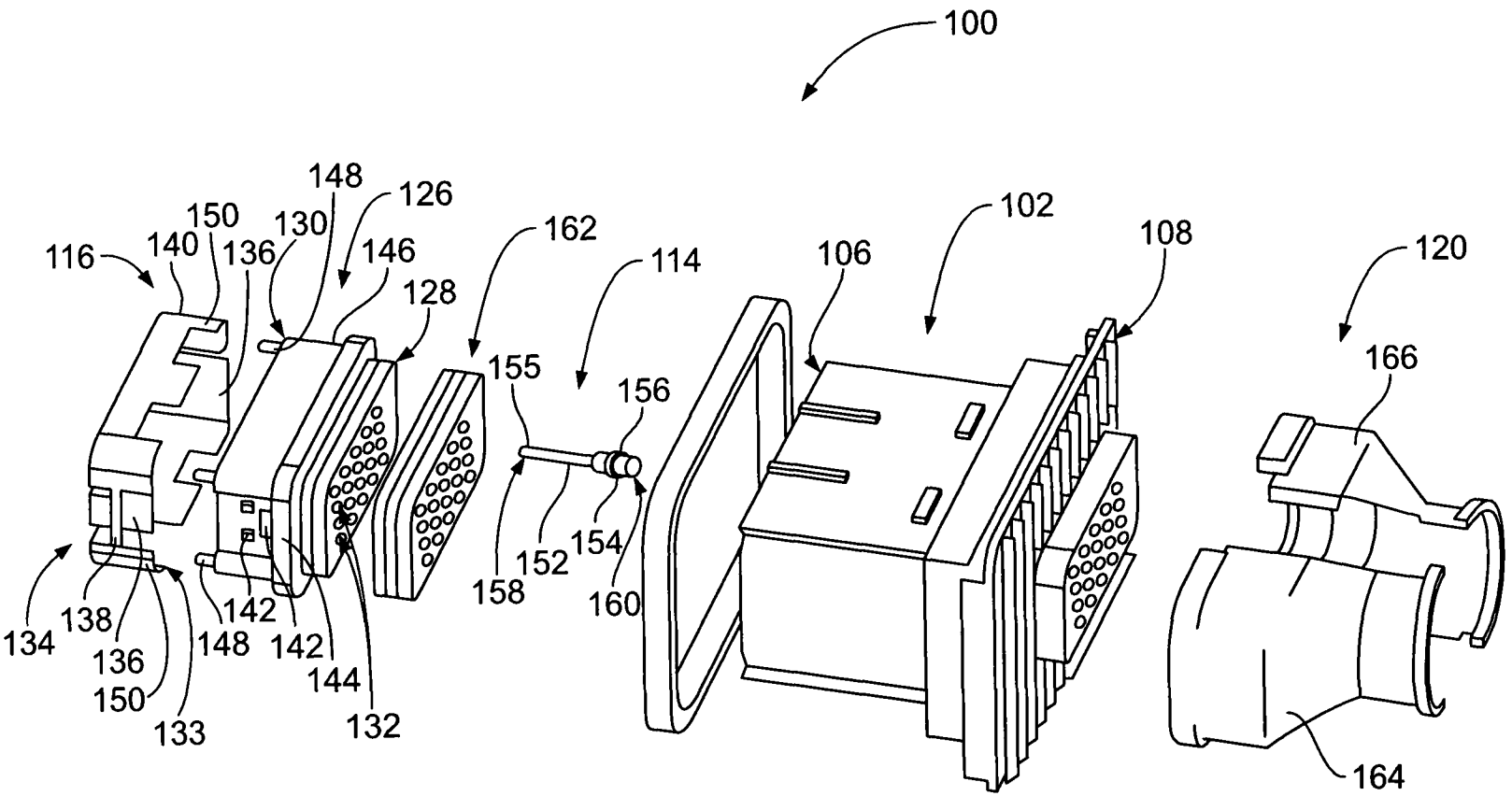
FIG. 2 is an exploded perspective view of the electrical connector according to an embodiment.

FIG. 2 is an exploded perspective view of the electrical connector 100 according to an embodiment. In addition to the TPA clip 116 and the contacts 114, the housing 102 also includes a terminal retention (TR) block 126 mounted to the housing 102 and held within the cavity 104 (shown in FIG. 1). The TR block 126 includes a proximal end 128 and a distal end 130. The proximal end 128 is more proximate to the terminating end 108 of the housing 102 than the distal end 130. Likewise, the distal end 130 is more proximate to the mating end 106 of the housing 102 than the proximal end 128 (when the TR block 126 is held within the cavity 104). The TR block 126 defines multiple channels 132 that extend between the proximal end 128 and the distal end 130. The channels 132 are configured to receive the contacts 114 therein. For example, each channel 132 may be configured to receive one contact 114. The TR block 126 may be formed of a dielectric material, such as a thermoplastic. The TR block 126 may be electrically insulative. Optionally, the TR block 126 may be formed by a molding process.

The TPA clip 116 is configured to be mounted to the distal end 130 of the TR block 126 within the housing 102. The TPA clip 116 includes a loading end 133 and an opposite forward end 134. The loading end 133 faces the distal end 130 of the TR block 126. The forward end 134 faces outward, toward the opening 110 (shown in FIG. 1) at the mating end 106 of the housing 102 when the TPA clip 116 is within the cavity 104 (FIG. 1). The TPA clip 116 may be formed of a dielectric material, such as a thermoplastic. The TPA clip 116 may be formed by a molding process.

In an embodiment, the TPA clip 116 is mounted to the TR block 126 via mounting latches 136 on the TPA clip 116. In the illustrated embodiment, the mounting latches 136 are located on a first side 138 and an opposite second side 140 of the TPA clip 116. The mounting latches 136 are configured to engage catches 142 along a first side 144 and a second side 146 of the TR block 126 to retain the TPA clip 116 to the TR block 126. The mounting latches 136 may be releasable to remove the TPA clip 116 from the TR block 126 when desired. In the illustrated embodiment, the TR block 126 further includes alignment posts 148 that extend from the distal end 130. The alignment posts 148 are configured to be received in corresponding sleeves 150 of the TPA clip 116 as the TPA clip 116 is moved towards the TR block 126 to align the TPA clip 116 and the TR block 126 with one another. Optionally, the alignment posts 148 and the sleeves 150 are located at corners of the respective TR block 126 and TPA clip 116. Although not shown in FIG. 2, when the TPA clip 116 is aligned with the TR block 126, the slots 118 (shown in FIG. 1) align with the channels 132 of the TR block 126, such that the channels 132 are fluidly coupled to the slots 118. The term "fluidly coupled" means that a fluid, such as air, in the channel 132 would be permitted to flow into the corresponding slot 118, and vice-versa, because the channel 132 and the slot 118 are adjacent to each other and have openings that are aligned with each other.

One contact 114 is shown in FIG. 2. The contact 114 is a pin contact 114. The contact 114 has a pin segment 152 at a front end 158 of the contact 114. The pin segment 152 extends from a base segment 154 at a rear end 160 of the contact 114 to a distal tip 155 at the front end 158. As used herein, relative or spatial terms such as "top," "bottom," "left," "right," "front," and "rear" are only used to distinguish the referenced elements and do not necessarily require particular positions or orientations in the electrical connector 100 or in the surrounding environment of the electrical connector 100. The base segment 154 is configured to terminate to a wire (not shown) that extends from the rear end 160 of the contact 114. The base segment 154 has a larger diameter than the pin segment 152. For example, in an embodiment, the base segment 154 is 1.5 mm in diameter, and the pin segment 152 is 1.0 mm in diameter. The base segment 154 includes a bead 156 that extends at least partially around a perimeter of the base segment 154. The diameter of the bead 156 is greater than the diameter of the base segment 154. The bead 156 is used to retain the contact 114 in one of the respective channels 132 of the TR block 126. In an embodiment, the contact 114 is formed of a conductive material, such as copper, silver, or one or more other metals. Optionally, the contact 114 may be stamped and formed from a panel of sheet metal.

In the illustrated embodiment, the electrical connector 100 further includes a wire seal 162. The wire seal 162 abuts or is at least proximate to the proximal end 128 of the TR block 126. The wire seal 162 is configured to surround and extend between the wires (not shown) connected to the contacts 114. The wire seal 162 may be at least partially compressive and seals around the wires to prevent the transmission of contaminants, such as liquids, dirt, dust, and sand, therethrough. For example, when the connector 100 is mated to a mating connector, the wire seal 162 may prevent contaminants from entering the cavity 104 (shown in FIG. 1) through openings at the terminating end 108 of the housing 102 (where the cable 112 shown in FIG. 1 extends from the housing 102). The cable 112 may include a plurality of the wires grouped within an outer jacket. The optional cable cover 120 may be formed by the releasable coupling of a first shell 164 and a second shell 166.

Figure 3:
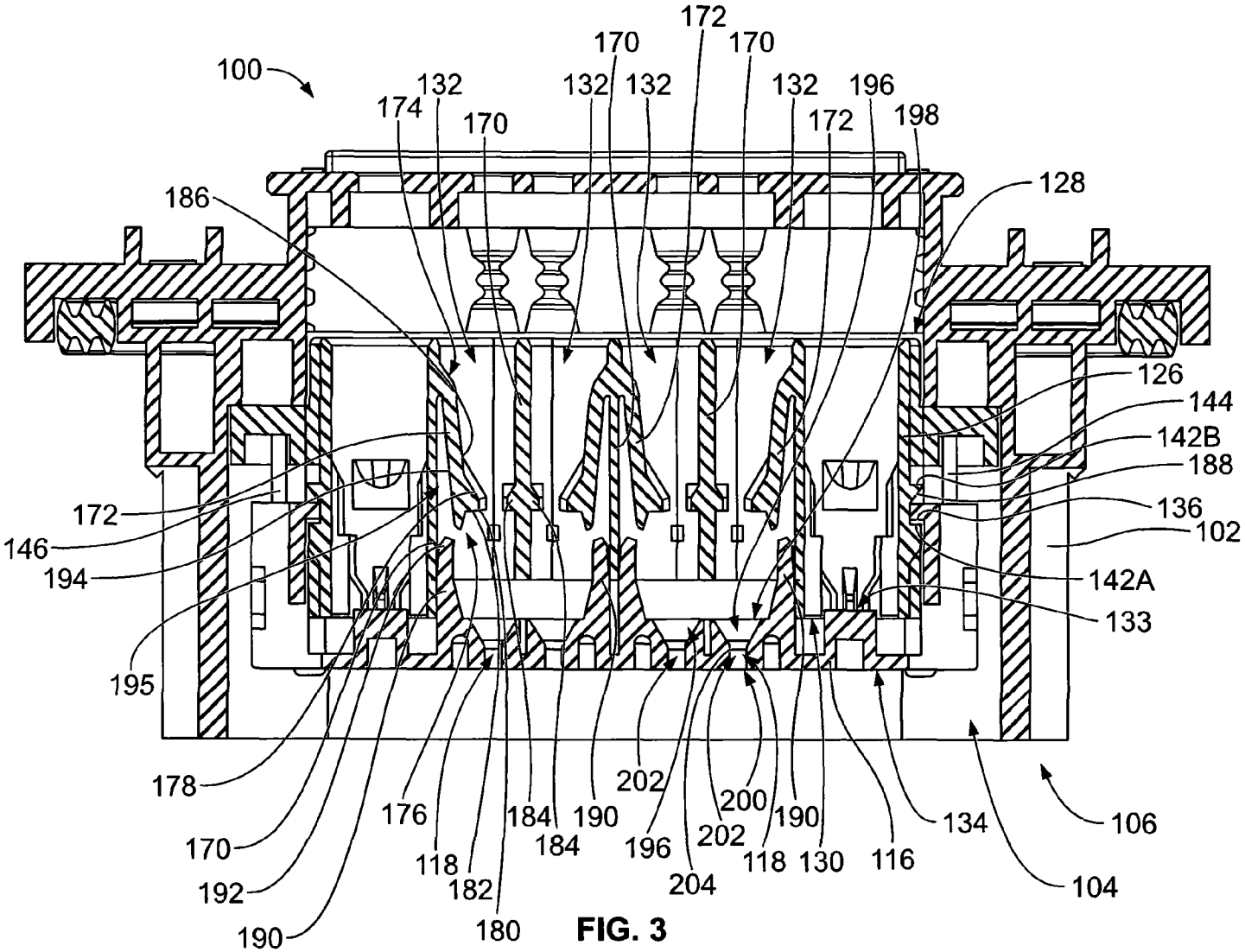
FIG. 3 is a cross-section of the electrical connector according to an exemplary embodiment.

FIG. 3 is a cross-section of the electrical connector 100 according to an exemplary embodiment. In FIG. 3, a portion of the housing 102 at the mating end 106 is not shown. The electrical connector 100 also does not show any of the contacts 114 or the cable 112 (both shown in FIG. 1). The cross-section in FIG. 3 extends across a row of channels 132 in the TR block 126. The TR block 126 in the illustrated embodiment includes four channels 132 in the row. The channels 132 are separated and divided from nearest (or adjacent) channels 132 by interior walls 170.

The channels 132 include deflectable retention latches 172 therein. The retention latches 172 extend into the channels 132 from the interior walls 170. The retention latches 172 are configured to engage the contacts 114 (shown in FIG. 2) in the channels 132 to retain the contacts 114 in the channels 132. In an embodiment, each channel 132 includes one retention latch 172. In an alternative embodiment, at least some of the channels 132 may include more than one retention latch 172. The retention latches 172 are cantilevered beams that have a fixed end 174 and a free end 176. The fixed end 174 is directly secured to the interior wall 170, unlike the free end 176. The fixed end 174 is located more proximate to the proximal end 128 of the TR block 126 than the free end 176. The free end 176 of each retention latch 172 is resiliently deflectable along an arc from the natural resting position of the latch 172 in a direction towards the interior wall 170 from which the latch 172 extends. The resilience of the retention latch 172 (i.e., the bias of the free end 176 of the latch 172 to the natural resting position thereof) generates a retention force between the latch 172 and the contact 114 within the channel 132. The retention force pushes the contact 114 towards the interior wall 170 opposite to the latch 172.

The retention latches 172 each include a ramp 178 proximate to the free end 176. The thickness of the ramp 178 increases with distance along the latch 172 towards the free end 176. The ramp 178 is configured to engage the contact 114 (shown in FIG. 2) as the contact 114 is loaded into the channel 132. For example, as the contact 114 enters the channel 132, the contact 114 engages and moves along the ramp 178, and the retention latch 178 at least partially deflects away from the contact 114 to allow the contact 114 to be moved farther into the channel 132. The increasing thickness of the ramp 178 causes the retention latch 172 to deflect an increasing distance along the arc towards the interior wall 170 as the contact 114 moves along the ramp 178. A distal edge 180 of the ramp 178 forms a catch 182 that is configured to be received behind a shoulder or bead of the contact 114 once the contact 114 is fully loaded in the channel 132 to lock and retain the contact 114 in the channel 132. For example, the catch 182 engages the shoulder or bead to prevent backward movement of the contact 114 towards the proximal end 128 of the TR block 126.

In the illustrated embodiment, each channel 132 also includes a protuberance 184. Each protuberance 184 extends into the respective channel 132 from an interior wall 170 of the channel 132. The protuberance 184 may be located along the interior wall 170 across from the retention latch 172, such as directly across from a front side 186 of the latch 172. The ramp 178 extends along the front side 186 of the latch 172. The protuberance 184 may be a bump, a bulge, or another protrusion. In an embodiment, the retention forces applied on the contacts 114 (shown in FIG. 2) by the retention latches 172 is directed towards the protuberances 184 such that the latches 172 force the contacts 114 into engagement with the protuberances 184. The protuberances 184 provide retention for the contacts 114 due to interference or friction at the engagement interfaces between the protuberances 184 and the contacts 114. Thus, the protuberances 184 support retention of the contacts 114. In addition, the protuberances 184 provide guidance for the contacts 114 as the contacts 114 are advanced into the channels 132 because the protuberances 184 force the contacts 114 radially inward and reduce the likelihood of the contacts 114 stubbing against the interior walls 170 of the channels 132.

In an embodiment, the channels 132 do not include any retention features or guide features distal to the retention latches 172 and the protuberances 184 (for example, at or proximate to the distal end 130 of the TR block 126). For example, the channels 132 may not taper towards the distal end 130. Also, the channels 132 do not include built-in guide posts or ramps at the distal end 130, which is unlike some known electrical connectors that include TPA devices through which the contacts extend to enter a cavity of the connector. Since the channels 132 do not include many of the complex and small features present in some known electrical connectors, the TR block 126 (and the electrical connector 100 in general) may be easier and cheaper to produce than the known connectors. In one or more alternative embodiments, however, the TR block 126 may include at least some guide features and/or retention features proximate to the distal end 130.

The TPA clip 116 is mounted to the TR block 126 within the cavity 104 of the housing 102 in FIG. 3. The TPA clip 116 is configured to be movable relative to the TR block 126 between a locked position and an unlocked (or staged) position. In FIG. 3, the TPA clip 116 is in the unlocked position. In an embodiment, the TR block 126 includes a distal catch 142A and a proximal catch 142B on each of the first and second sides 144, 146 of the TR block 126. The distal catches 142A are located closer to the distal end 130 of the TR block 126 than the proximal catches 142B. The mounting latches 136 of the TPA clip 116 engage corresponding distal catches 142A when the TPA clip 116 is in the unlocked position, as shown in FIG. 3, to retain the TPA clip 116 in the unlocked position (and prevent the TPA clip 116 from uncoupling from the TR block 126). As described further below, as the TPA clip 116 is moved towards the proximal end 128 of the TR block 126 to the locked position, the mounting latches 136 are configured to engage the corresponding proximal catches 142B to retain the TPA clip 116 in the locked position. An intermediate ledge 188 along the sides 144, 146 of the TR block 126 between the distal and proximal catches 142A, 142B may be ramped to allow the mounting latches 136 to slide along the ledge 188 and partially deflect as the TPA clip 116 transitions from the unlocked position to the locked position. In an alternative embodiment, the TR block 126 includes only one catch on each side, and the mounting latches of the TPA clip 116 include both distal and proximal latching features to allow for coupling in the locked and unlocked positions. In another alternative embodiment, the TR block 126 includes the mounting latches and the TPA clip 116 includes the catches.

The TPA clip 116 includes locking posts 190 that are elongated and extend from the loading end 133 of the TPA clip 116. The locking posts 190 are located at sides of the slots 118. The locking posts 190 extend generally parallel to each other towards the TR block 126. At least tips 192 of the locking posts 190 are received in the channels 132 of the TR block 126 when the TPA clip 116 is in the locked position. Optionally, as shown in the illustrated embodiment, the tips 192 are within the channels 132 even when the TPA clip 116 is in the unlocked position and is farther from the TR block 126. The locking posts 190 are configured to be wedged between a back side 194 of the retention latches 172 and the interior walls 170 (for example, a back wall) from which the latches 172 extend when the TPA clip 116 is in the locking position. When wedged behind the latches 172, the locking posts 190 mechanically block the retention latches 172 from deflecting away from the corresponding contacts 114 (shown in FIG. 2) and towards the back interior walls 170. By prohibiting deflection of the latches 172, the locking posts 190 reinforce the retention of the contacts 114 in the channels 132. Thus, the TPA clip 116 provides a secondary lock (to the primary lock provided by the latches 172) that retains the contacts 114 in the channels 132. In addition, the TPA clip 116 is configured to provide position assurance. For example, if one of the contacts 114 is not fully loaded in the respective channel 132, the retention latch 172 that engages the contact 114 is deflected towards the back interior wall 170 to a position such that a gap 195 defined between the back side 194 of the latch 172 and the wall 170 is too narrow to receive the corresponding locking post 190. Since the locking post 190 does not fit within the gap 195, the TPA clip 116 is prohibited from moving all of the way to the locked position, which indicates that at least one of the contacts 114 is not in a fully loaded position.

The slots 118 of the TPA clip 116 extend entirely through the TPA clip 116 between the loading end 133 and the forward end 134. The slots 118 align with the channels 132 of the TR block 126. Thus, the TPA clip 116 includes four slots 118 shown in FIG. 3 that align with the row of four channels 132. The slots 118 are configured to receive the distal tips 155 (shown in FIG. 2) of the contacts 114 (FIG. 2). In an embodiment, the slots 118 include tapered lead-ins 196 at the leading end 133 that are configured to guide the distal tips 155 of the contacts 114 from the channels 132 into the slots 118. Due to the tapered lead-ins 196, the slots 118 each have an entrance 198 at the loading end 133 that has a larger diameter than an exit 200 of the slots 118 at the forward end 134. In an embodiment, the slots 118 each include the tapered lead-in 196 and a narrow portion 202 that extends between the lead-in 196 and the exit 200 at the forward end 134. The lead-ins 196 are tapered such that a diameter of each lead-in 196 decreases with depth of the slot 118. For example, the largest diameter of each lead-in 196 is at the entrance 198 along the loading end 133, and the smallest diameter of the lead-in 196 is at a confluence 204 between the lead-in 196 and the narrow portion 202 of the slot 118. The narrow portion 202 may have a generally uniform or constant diameter. The diameter of the narrow portion 202 may be the diameter of the confluence 204, or, in other words, the smallest diameter of the lead-in 196. Thus, the tapered lead-ins 196 are sloped to guide the distal tips 155 of the contacts 114 from wider-diameter channels 132 of the TR block 126 to narrower-diameter narrow portions 202 of the slots 118 of the TPA clip 116. The exits 200 of the slots 118 are narrow in order to accurately control the position and orientation of the distal tips 155 of the contacts 114 in the cavity 104 of the housing 102. Such control may be required for the contacts 114 to accurately and reliably engage the corresponding mating contacts of the mating connector.

Figure 4B:
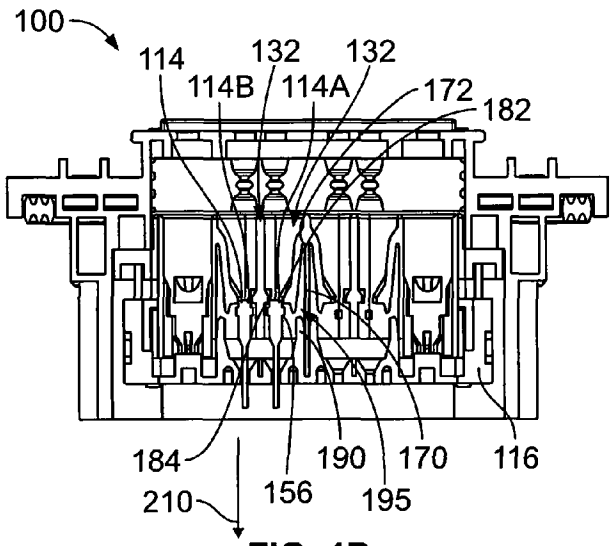
FIGS. 4A-4C show cross-sectional views of the electrical connector at various stages of assembly according to an embodiment.
Figure 4A:
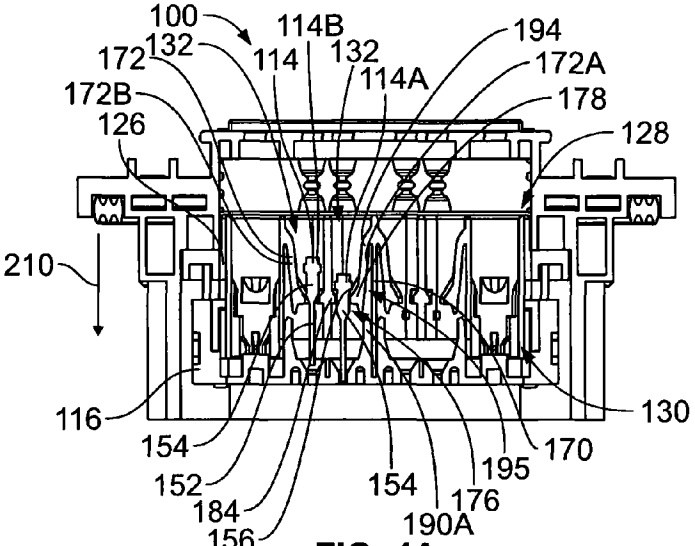
Figure 4C:
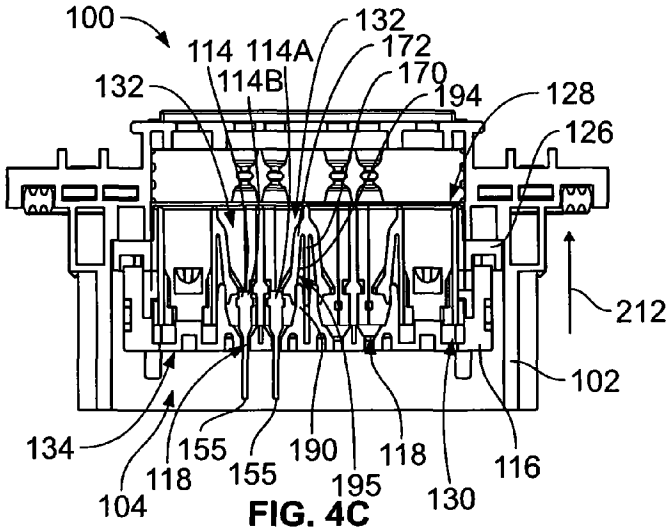

FIGS. 4A-4C show cross-section views of the electrical connector 100 at various stages of assembly according to an embodiment. In FIG. 4A, two contacts 114 are partially loaded in respective channels 132 of the TR block 126. The two contacts 114 include a first contact 114A and a second contact 114B. The TR block 126 is configured for the contacts 114 to be loaded into the channel 132 in a loading direction 210. The loading direction 210 is from the proximal end 128 towards the distal end 130. The loading direction 210 is parallel to the channels 132. As shown in FIG. 4A, the first contact 114A is located farther within the respective channel 132 and is closer to a fully loaded position than the second contact 114B. As described above, the retention latches 172 in the channels 132 are configured to engage and at least partially deflect as the corresponding contacts 114 are loaded into the channels 132.

As shown in FIG. 4A, the retention latch 172A in the same channel 132 as the first contact 114A is in a deflected or biased state. For example, the ramp 178 of the latch 172A is engaged with the base segment 154 and/or the bead 156 of the contact 114A. The base segment 154 of the contact 114A is sandwiched between the protuberance 184 and the latch 172A, and the latch 172A is deflected away from the contact 114A towards the interior wall 170 due to the size of the base segment 154. The retention latch 172B in the same channel 132 as the second contact 114B is not in a deflected or biased position. Since the second contact 114B is not loaded as far as the first contact 114A, the latch 172B engages a transition between the small diameter pin segment 152 and the larger diameter base segment 154. The term "biased position" refers to the deflection of the latches 172 due to engagement with a side of the base segments 154 of the contacts 114 or with the beads 156 that extend from the base segments 154. The latch 172B may be partially deflected due to the engagement with the pin segment 152 or the transition between the pin segment 152 and the base segment 154, but the latch 172B is not in the biased position and is not deflected to the same degree as the other retention latch 172A. Thus, both contacts 114A, 114B shown in FIG. 4A are partially loaded, but only the latch 172A that engages the first contact 114A is in the biased position.

In FIG. 4A, the TPA clip 116 is in the unlocked position. The electrical connector 100 is configured such that the TPA clip 116 is not movable from the unlocked position to the locked position relative to the TR block 126 until the contacts 114 are fully loaded in the respective channels. For example, since the retention latch 172A is in the biased position, the gap 195 between the back side 194 of the latch 172A and the interior wall 170 is too narrow to receive the corresponding locking post 190A of the TPA clip 116. Thus, if the TPA clip 116 is advanced towards the proximal end 128 of the TR block 126, the locking post 190A would strike the end 176 of the latch 172A and not be able to fit within the gap 195, which blocks further movement of the TPA clip 116. Thus, any latch 172 in the biased position blocks the TPA clip 116 from transitioning from the unlocked position to the locked position.

FIG. 4B shows both of the contacts 114A, 114B in fully loaded positions within the respective channels 132, while the TPA clip 116 remains in the unlocked position. To reach the fully loaded position, the contacts 114 are each advanced in the loading direction 210 until the bead 156 is moved beyond the catch 182 of the retention latch 172. The retention latch 172 in the biased position is biased to move in the direction towards the contact 114, so when the force applied on the latch 172 by the bead 156 is removed as the bead 156 moves beyond the catch 182, the latch 172 moves at least partially towards the natural resting position of the latch 172. The catch 182 may engage an edge of the bead 156 to retain the contact 114 in the channel 132 between the latch 172 and the protuberance 184. The movement of the latch 172 towards the natural resting position increases the gap 195 between the latch 172 and the interior wall 170 that the latch 172 extends from. Thus, when the contacts 114 are in the fully loaded positions, the gaps 195 are large enough to allow the locking posts 190 of the TPA clip 116 to be received therein, allowing the TPA clip 116 to be moved to the locked position.

FIG. 4C shows the contacts 114A, 114B in the fully loaded positions, and the TPA clip 116 is in the locked position. The TPA clip 116 is moved in a locking direction 212 from the unlocked position to the locked position. The locking direction 212 extends from the distal end 130 of the TR block 126 towards the proximal end 128, and is parallel to the channels 132. For example, the locking direction 212 may be opposite to the loading direction 210 of the contacts 114. In the locked position, the locking posts 190 are disposed in the gaps 195 between the back sides 194 of the corresponding retention latches 172 and the interior walls 170. The locking posts 190 in the gaps 195 mechanically block the retention latches 172 from deflecting away from the contacts 114. For example, the locking posts 190 form wedges in the gaps 195 that reduce and/or eliminate the space that the latches 172 can deflect into. The TPA clip 116 thus provides a secondary lock because the locking posts 190 support the latches 172, which provide primary retention of the contacts 114. Due to the locking posts 190, the amount of force required to push the contacts 114 out of the fully loaded positions back towards the proximal end 128 of the TR block 126 is greatly increased. As shown in FIG. 4C, when the TPA clip 116 is in the locked position, the contacts 114 extend through the slots 118 of the TPA clip 116, and the distal tips 155 of the contacts 114 are disposed beyond the forward end 134 of the TPA clip 116 within the cavity 104 of the housing 102.

Figure 5:
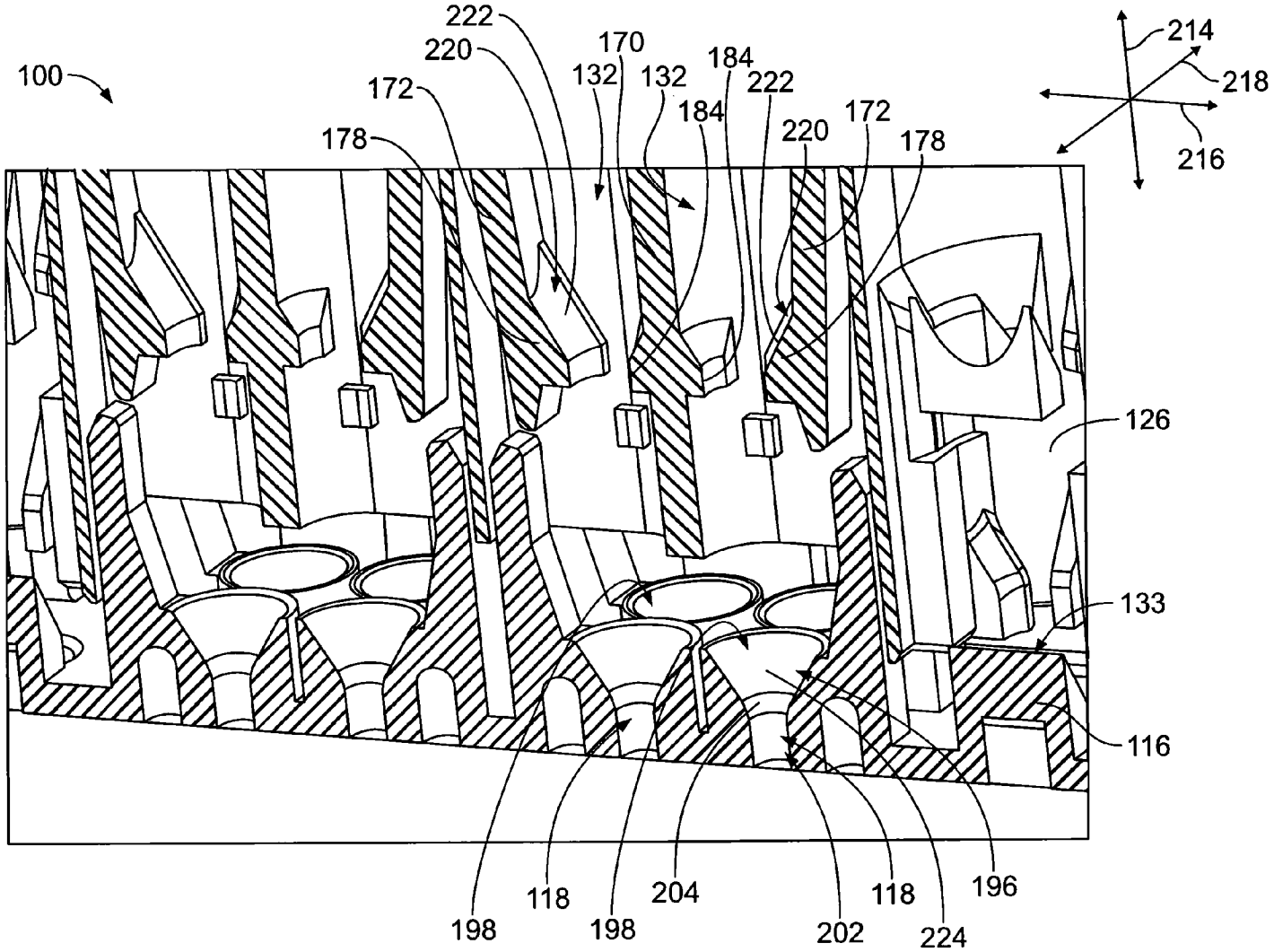
FIG. 5 is a close-up cross-sectional perspective view of a portion of the electrical connector showing a TPA clip and a TR block according to an embodiment.

FIG. 5 is a close-up cross-sectional perspective view of a portion of the electrical connector 100 showing the TPA clip 116 and the TR block 126 according to an embodiment. In an embodiment, the electrical connector 100 is configured to provide guidance for the contacts 114 (shown in FIG. 2) as the contacts 114 are loaded in the channels 132 of the TR block 126 and through the slots 118 of the TPA clip 116 in 360 degrees. For example, the electrical connector 100 is oriented with respect to a vertical axis 214, a lateral axis 216, and a longitudinal axis 218. The axes 214-218 are mutually perpendicular. It is understood that the axes 214-218 are not required to have any particular orientation with respect to gravity. The channels 132 are oriented parallel to the vertical axis 214. Thus, movement of the contacts 114 along the vertical axis 214 is controlled as the contacts 114 are loaded. As the contacts 114 are loaded into the channels 132, the distal tips 155 (shown in FIG. 2) of the contacts 114 have a tendency to project in various angles along the plane defined by the lateral and longitudinal axes 216, 218. But, the electrical connector 100 is configured to provide 360 degree guidance (for example, along the lateral and longitudinal plane) for the contacts 114 through the channels 132 and into the narrow portions 202 of the slots 118 without stubbing along the way. Two components that may provide such 360 degree guidance are the retention latches 172 on the TR block 126 and the tapered lead-ins 196 on the TPA clip 116.

For example, the latch 172 is across from the protuberance 184 along the lateral axis 216. The latch 172 and the protuberance 184 engage opposite sides of the corresponding contact 114 (shown in FIG. 2) to control the lateral position of the contact 114 within the channel 132. Optionally, the ramp 178 of the latch 172 includes a concave trench 220. Only a portion of the trenches 220 is shown in the cross-sectional view of FIG. 5. The corresponding contact 114 is received in the trench 220 as the contact 114 is loaded into the channel 132, and the concave surface 222 of the trench 220 provides guidance along the longitudinal axis 218 as well as along the lateral axis 216. Thus, the trench 220 directs the contact 114 longitudinally towards a center of the channel 132 and laterally towards the protuberance 184. The protuberance 184, as described above, prohibits the contact 114 from stubbing on the interior wall 170 that the protuberance 184 extends from.

In an embodiment, the tapered lead-ins 196 of the slots 118 of the TPA clip 116 are conical and provide 360 degree guidance for the distal tips 155 (shown in FIG. 2) of the contacts 114 (FIG. 2) towards the narrow portions 202 of the slots 118. The tapered lead-ins 196 are tapered in 360 degrees along the plane defined by the lateral and longitudinal axes 216, 218, such that the lead-ins 196 resemble funnels or cones. Optionally, the entrances 198 of the slots 118 at the loading end 133 of the TPA clip 116 are circular. The confluences 204, where the lead-ins 196 transition to the narrow portions 202, may also be circular, and the confluences 204 are concentric with the circular entrances 198. Due to the conically-shaped lead-ins 196, as long as the distal tip 155 of each contact 114 is received within the entrance 198, the lead-in 196 guides the distal tip 155 towards the narrow portion 202. The entrance 198 may be generally the same size as the channel 132, such that there is no risk of the distal tip 155 stubbing on the edges of the entrance 198 and not entering the entrance 198. Upon entering the lead-in 196 of the slot 118, the distal tip 155 may be displaced from alignment with the narrow portion 202 by a length along the lateral axis 216, along the longitudinal axis 218, or along both axes 216, 218. Still, regardless of where the distal tip 155 initially engages the lead-in 196, the conical surface 224 of the tapered lead-in 196 guides or funnels the distal tip 155 towards and into the narrow portion 202 as the contact 114 is advanced further in the loading direction 210 (shown in FIG. 4A). The conical tapered lead-in 196 is configured to provide guidance that reduces (or eliminates) stubbing without the need for additional guiding features on the TR block 126 or the TPA clip 116.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical connector comprising:

a housing having a mating end and a terminating end, the housing defining a cavity open at the mating end;

a terminal retention (TR) block mounted to the housing within the cavity, the TR block including multiple interior walls that are rigid and define multiple channels extending between a proximal end and a distal end of the TR block, each of the channels including a deflectable retention latch extending into the respective channel from one of the interior walls, the retention latch resiliently deflectable relative to the interior wall from which the retention latch extends and configured to engage one of the contacts to retain the contact in the channel, each of the channels also including an undeflectable protuberance extending into the channel from another of the interior walls, the undeflectable protuberance located across from the retention latch in the channel and configured to engage the corresponding contact within the channel; and a terminal position assurance (TPA) clip mounted to the distal end of the TR block within the cavity of the housing, the TPA clip configured to block deflection of the retention latches to lock the contacts in the channels, the TPA clip having slots that align with the channels of the TR block and receive distal tips of the contacts therethrough, the slots having tapered lead-ins configured to guide the distal tips of the contacts from the channels into the slots.

2. The electrical connector of claim 1, wherein the TPA clip includes a loading end and an opposite forward end, the loading end facing the distal end of the TR block, the slots having an entrance at the loading end that has a larger diameter than an exit of the slots at the forward end.

3. The electrical connector of claim 2, wherein the tapered lead-ins of the slots are conical and provide 360 degree guidance for the distal tip of the corresponding contact towards a narrow portion of the respective slot, the narrow portion extending between the tapered lead-in and the exit at the forward end.

4. The electrical connector of claim 1, wherein the TPA clip is movable relative to the TR block between a locked position and an unlocked position, the TPA clip configured to not be movable from the unlocked position to the locked position until the contacts are fully loaded in the respective channels.

5. The electrical connector of claim 4, wherein the TPA clip includes locking posts that extend into the channels of the TR block, the locking posts being disposed between a back side of the corresponding retention latch and an interior wall of the respective channel when the TPA clip is in the locked position to mechanically block the retention latch from deflecting away from the corresponding contact in order to lock the contact in the channel.

6. The electrical connector of claim 4, wherein the contacts are loaded into the channels of the TR block in a loading direction from the proximal end towards the distal end of the TR block, the TPA clip being movable in a locking direction from the distal end towards the proximal end of the TR block as the TPA clip transitions from the unlocked position to the locked position.

7. The electrical connector of claim 4, wherein, when the TPA clip is in the locked position, the contacts extend through the slots such that the distal tips of the contacts are disposed within the cavity beyond a forward end of the TPA clip.

8. The electrical connector of claim 1, wherein the retention latches each include a ramp and a catch at a distal edge of the ramp, the ramp configured to engage and at least partially deflect away from a corresponding contact as the contact is loaded into the respective channel, the retention latch being biased to move towards the contact when a bead of the contact is moved past the catch, the catch engaging an edge of the bead to retain the contact in the channel.

9. The electrical connector of claim 1, wherein the retention latches are cantilevered beams having a fixed end and a free end, the fixed end located more proximate to the proximal end of the TR block than the free end.

10. The electrical connector of claim 1, wherein the TPA clip is mounted to the distal end of the TR block via mounting latches on opposite first and second sides of the TPA clip, the mounting latches each configured to engage at least two different catches along first and second sides of the TR block to move the TPA clip between a locked position and an unlocked position relative to the TR block.

11. The electrical connector of claim 1, wherein at least one of the interior walls of the TR block has a first surface that defines a portion of a first channel of the multiple channels and an opposite, second surface that defines a portion of a second channel of the multiple channels, each of the first and second surfaces including a different one of the undeflectable protuberances extending therefrom into the corresponding first and second channels.

12. The electrical connector of claim 1, wherein the interior walls of the TR block are fixed in place relative to the housing when the TR block is mounted to the housing.

13. An electrical connector comprising:

a housing having a mating end and a terminating end, the housing defining a cavity open at the mating end;

a terminal retention (TR) block mounted to the housing within the cavity, the TR block including multiple interior walls that are rigid and define multiple channels extending between a proximal end and a distal end of the TR block, each of the channels including a deflectable retention latch extending into the respective channel from one of the interior walls, the retention latch resiliently deflectable relative to the interior wall from which the retention latch extends, each of the channels also including an undeflectable protuberance extending into the channel from another of the interior walls, the undeflectable protuberance located across from the retention latch in the channel;

multiple contacts disposed within corresponding channels of the TR block, each contact engaging and being retained in the respective channel by the retention latch and the undeflectable protuberance within the channel; and a terminal position assurance (TPA) clip mounted to the distal end of the TR block within the cavity of the housing, the TPA clip configured to block deflection of the retention latches to lock the contacts in the channels, the TPA clip having slots that align with the channels of the TR block and receive distal tips of the contacts therethrough, the slots having tapered lead-ins configured to guide the distal tips of the contacts from the channels into narrow portions of the slots, the tapered lead-ins being conical and providing 360 degree guidance for the distal tips into the narrow portions of the slots.

14. The electrical connector of claim 13, wherein the TPA clip includes a loading end and an opposite forward end, the loading end facing the distal end of the TR block, the tapered lead-ins of the slots having entrances at the loading end, the narrow portions of the slots extending between the tapered lead-ins and the forward end, the narrow portions having exits at the forward end.

15. The electrical connector of claim 13, wherein a diameter of each of the tapered lead-ins decreases with depth of the slot from a largest diameter at the entrance along the loading end to a smallest diameter at a confluence between the tapered lead-in and the narrow portion of the slot.

16. The electrical connector of claim 13, wherein the TPA clip is movable relative to the TR block between a locked position and an unlocked position, the TPA clip configured to not be movable from the unlocked position to the locked position until the contacts are fully loaded in the respective channels.

17. The electrical connector of claim 16, wherein the TPA clip includes locking posts that extend into the channels of the TR block, the locking posts being disposed between a back side of the corresponding retention latch and an interior wall of the respective channel when the TPA clip is in the locked position to mechanically block the retention latch from deflecting away from the corresponding contact in order to lock the contact in the channel.

18. The electrical connector of claim 17, wherein the contacts engage and at least partially deflect the corresponding retention latches towards the interior wall in a biased position when the contacts are partially loaded, the retention latches in the biased positions preventing the locking posts of the TPA clip from extending between the retention latches and the interior walls which blocks the TPA clip from being moved to the locked position when at least some of the contacts are only partially loaded.

19. The electrical connector of claim 16, wherein the contacts are loaded into the channels of the TR block in a loading direction from the proximal end towards the distal end of the TR block, the TPA clip being movable in a locking direction that is opposite to the loading direction as the TPA clip transitions from the unlocked position to the locked position.

20. The electrical connector of claim 13, wherein the retention latches each include a ramp and a catch at a distal edge of the ramp, the ramp configured to engage and at least partially deflect away from a corresponding contact as the contact is loaded into the respective channel, the retention latch being biased to move towards the contact when a bead of the contact is moved past the catch, the catch engaging an edge of the bead to retain the contact in the channel.

* * * * *